US010471311B2

(12) United States Patent
Kato

(10) Patent No.: US 10,471,311 B2
(45) Date of Patent: Nov. 12, 2019

(54) GOLF CLUB HEAD

(71) Applicant: SUMITOMO RUBBER INDUSTRIES, LTD., Kobe-shi, Hyogo (JP)

(72) Inventor: Masatoshi Kato, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/031,413

(22) Filed: Jul. 10, 2018

(65) Prior Publication Data

US 2019/0015713 A1 Jan. 17, 2019

(30) Foreign Application Priority Data

Jul. 11, 2017 (JP) ..... 2017-135399

(51) Int. Cl.
*A63B 53/04* (2015.01)

(52) U.S. Cl.
CPC .. *A63B 53/0466* (2013.01); *A63B 2053/0408* (2013.01); *A63B 2053/0437* (2013.01)

(58) Field of Classification Search
USPC ..... 473/324–350
See application file for complete search history.

(56) References Cited

U.S. PATENT DOCUMENTS 5,092,599 A * 3/1992 Okumoto ..... A63B 53/04 473/327
5,221,086 A * 6/1993 Antonious ..... A63B 53/04 473/327
5,482,279 A * 1/1996 Antonious ..... A63B 53/04 473/327
5,755,627 A * 5/1998 Yamazaki ..... A63B 53/04 473/345
6,139,446 A * 10/2000 Wanchena ..... A63B 53/04 473/349
7,396,297 B2 * 7/2008 Hirano ..... A63B 53/04 473/345

(Continued)

FOREIGN PATENT DOCUMENTS

JP 04082574 A * 3/1992
JP 07284546 A * 10/1995

(Continued)

*Primary Examiner* — Alvin A Hunter
(74) *Attorney, Agent, or Firm* — Birch, Stewart, Kolasch & Birch, LLP

(57) ABSTRACT

The golf club head according to the present invention includes a face portion, a crown portion and a sole portion, the crown portion including a first region extending in a toe-heel direction along at least part of the face portion, a second region arranged further on a back side than the first region, and a step region extending in the toe-heel direction between the first region and the second region and extending downward toward the second region from the first region side, and the second region including a first part arranged in a vicinity of the middle in the toe-heel direction and contacting the step region, and a second part having a thinner wall thickness than the first part and arranged to surround a periphery of the first part on the back side, the toe side and the heel side of the first part.

10 Claims, 5 Drawing Sheets

(56) References Cited

U.S. PATENT DOCUMENTS

| | | | | |
|---|---|---|---|---|
| 7,789,773 | B2 * | 9/2010 | Rae | A63B 53/0466 473/345 |
| 7,789,774 | B2 * | 9/2010 | Rae | A63B 53/0466 473/345 |
| 8,608,587 | B2 * | 12/2013 | Henrikson | A63B 53/0466 473/324 |
| 8,986,131 | B2 * | 3/2015 | Stites | A63B 53/0466 473/327 |
| 8,992,338 | B2 * | 3/2015 | Willett | A63B 53/04 473/327 |
| 9,144,721 | B2 * | 9/2015 | Golden | A63B 53/0466 |
| 10,022,598 | B2 * | 7/2018 | Willett | A63B 53/04 |
| D834,662 | S * | 11/2018 | Oyler | D21/752 |
| 2006/0079349 | A1 * | 4/2006 | Rae | A63B 53/0466 473/345 |
| 2008/0051210 | A1 * | 2/2008 | Park | A63B 53/047 473/291 |
| 2008/0051215 | A1 * | 2/2008 | Rae | A63B 53/0466 473/345 |
| 2012/0149494 | A1 * | 6/2012 | Takahashi | A63B 53/0466 473/345 |
| 2013/0324293 | A1 * | 12/2013 | Stites | A63B 53/0466 473/327 |

FOREIGN PATENT DOCUMENTS

| | | | | | |
|---|---|---|---|---|---|
| JP | 11155982 | A | * | 6/1999 | |
| JP | 11347158 | A | * | 12/1999 | |
| JP | 2001104525 | A | * | 4/2001 | |
| JP | 2002058762 | A | * | 2/2002 | |
| JP | 2007151758 | A | * | 6/2007 | A63B 53/0466 |
| JP | 2007325727 | A | * | 12/2007 | A63B 53/0466 |
| JP | 2008104864 | A | * | 5/2008 | |
| JP | 2012010926 | A | * | 1/2012 | |
| JP | 2012120685 | A | * | 6/2012 | |
| JP | 5882522 | B1 | | 3/2016 | |
| JP | 2017018753 | A | * | 1/2017 | |
| JP | 2017221848 | A | * | 12/2017 | |
| JP | 2018034021 | A | * | 3/2018 | |

* cited by examiner

E1 Cross-section

GOLF CLUB HEAD

TECHNICAL FIELD

The present invention relates to a golf club head.

BACKGROUND ART

In recent years, as disclosed in JP 5882522, for example, golf club heads have been proposed in which a raised portion is provided on the crown portion and a sloped surface is formed as a step between the raised portion and the portion rearward thereof. This configuration enables the height of the face portion to be raised by the height of the raised portion. Thus, the rebound performance of the face portion can be improved. Also, on the crown portion, only the raised portion is formed higher, and the portion rearward thereof is formed at a lower position than the raised portion, enabling the center of gravity of the head to be lowered.

JP 5882522 is an example of related art.

However, even with a golf club head having a structure such as described above, there is room for improvement in order to enhance the rebound performance, and it is desired to further increase the carry distance. The present invention was made in order to solve the above problem, and an object thereof is to provide a golf club head that is able to further enhance the rebound performance in a golf club head that has a raised portion formed on the crown portion.

SUMMARY OF THE INVENTION

A golf club head according to the present invention is provided with a face portion, a crown portion and a sole portion, the crown portion including a first region extending in a toe-heel direction along at least part of the face portion, a second region arranged further on a back side than the first region, a step region extending in the toe-heel direction between the first region and the second region and extending downward toward the second region from the first region side, and the second region including a first part arranged in a vicinity of a middle in the toe-heel direction and contacting the step region, and a second part having a thinner wall thickness than the first part and arranged to surround a periphery of the first part on the back side, the toe side and the heel side of the first part.

Note that the "toe-heel direction" need not be strictly in the toe-heel direction, and may be slightly angled.

In the above golf club head, the second part can have a plurality of thin-walled portions extending radially on the back side from the first part and having a thinner wall thickness than other regions of the second part.

In the above golf club heads, a length of the first part in a face-back direction can be 15 to 50% of a length of the second region in the face-back direction.

In the above golf club heads, a length of the first part in the toe-heel direction can be 20 to 75% of a length of the second region in the toe-heel direction.

In the above golf club heads, the first part can be formed to have a toe-side end portion in a position separated from a face center by 5 to 40 mm on the toe side, and to have a heel-side end portion in a position separated from the face center by 5 to 30 mm on the heel side.

In the above golf club heads, the first part can be formed such that the length in the toe-heel direction becomes shorter moving toward the back side.

In the above golf club heads, the first part can be formed such that an end edge contacting the step region and an end edge on the back side extend substantially parallel to each other in the toe-heel direction.

A golf club head according to the present invention enables the rebound performance to be further enhanced in a golf club head that has a raised portion formed on the crown portion.

EMBODIMENTS OF THE INVENTION

Hereinafter, an embodiment of a golf club head according to the present invention will be described, with reference to the drawings.

1. Overview of Golf Club Head

Figure 1:
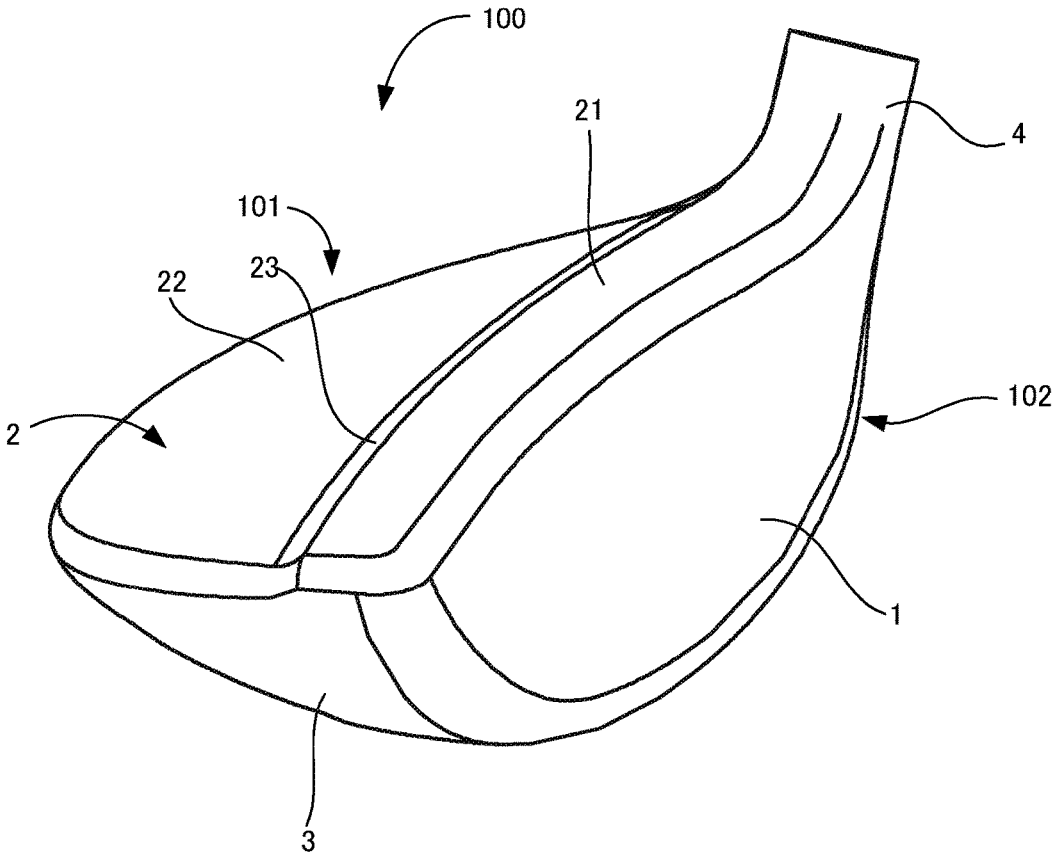
FIG. 1 is a perspective view of a golf club head according to an embodiment.
Figure 2:
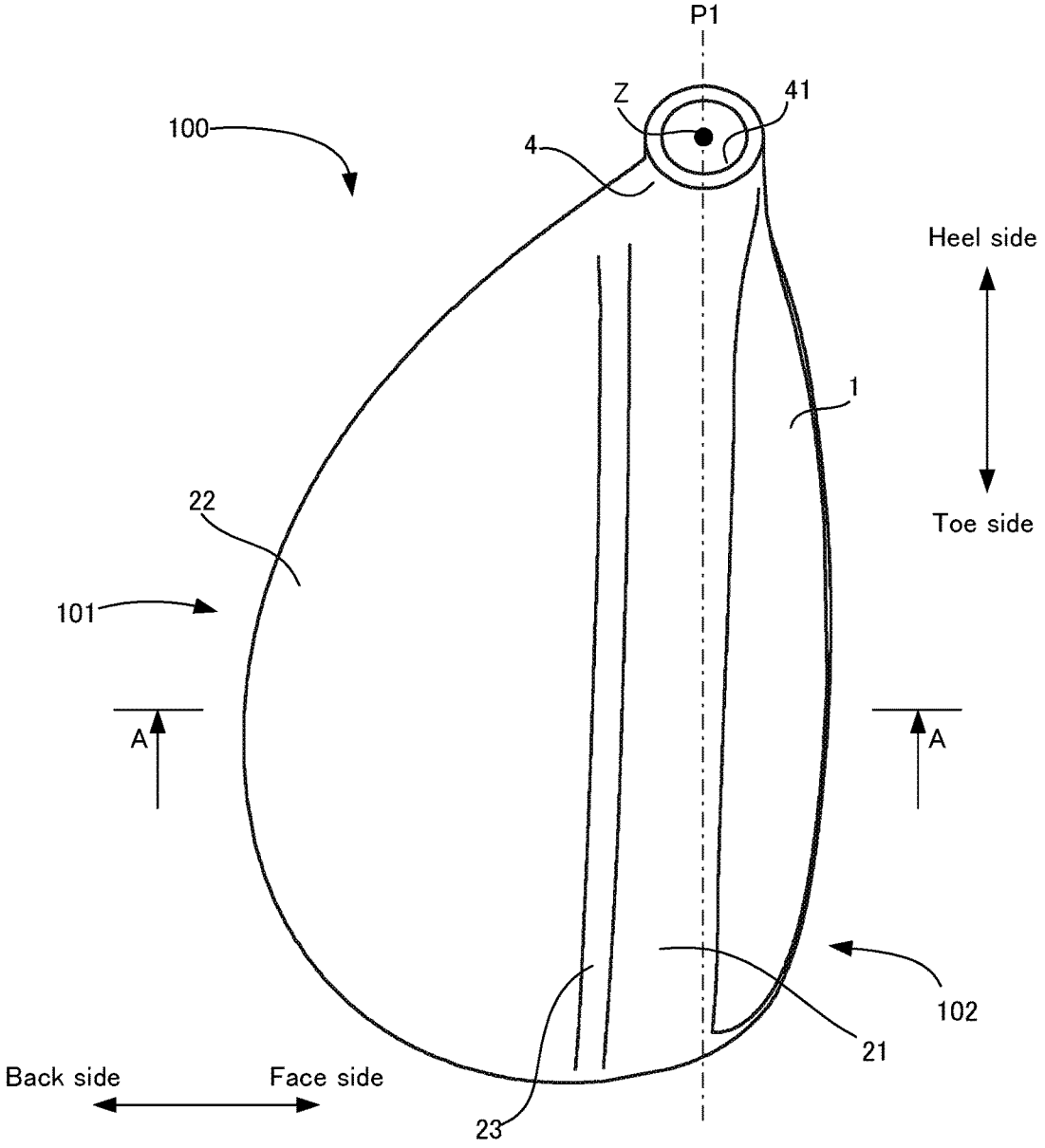
FIG. 2 is a plan view of a reference state of the golf club head in FIG. 1.
Figure 3:
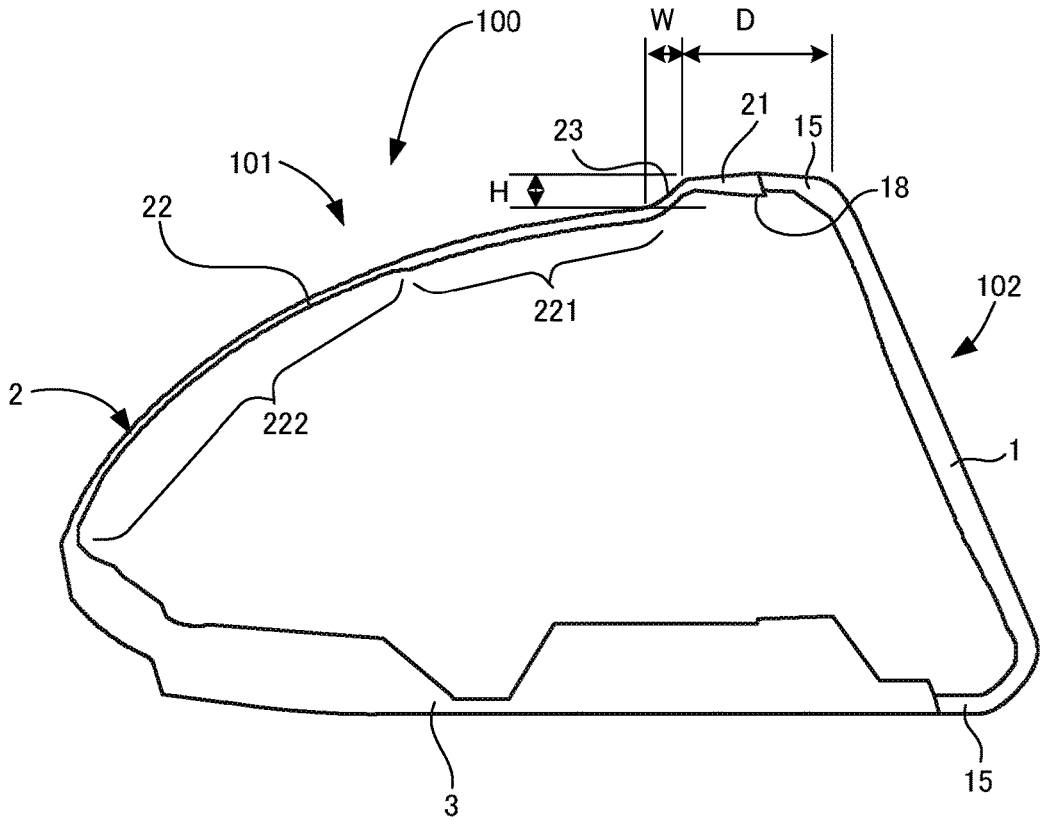
FIG. 3 is a cross-sectional view taken along an A-A line in FIG. 2.

FIG. 1 is a perspective view of this golf club head, FIG. 2 is a plan view of the head in a reference state, and FIG. 3 is a cross-sectional view taken along an A-A line in FIG. 2. As shown in FIGS. 1 to 3, this golf club head (hereinafter, may be referred to simply as "head") 100 is a wood-type golf club head having a hollow structure with an internal space, and a wall surface is formed by a face portion 1, a crown portion 2, a sole portion 3 and a hosel portion 4. Specifically, the present invention can be applied to golf club heads such as utilities (hybrids), fairway woods and drivers.

The face portion 1 has a face surface which is the surface that hits the ball, and the crown portion 2 adjoins the face portion 1 and constitutes the upper surface of the head 100. The sole portion 3 mainly constitutes the bottom surface of the head 100, and constitutes the outer peripheral surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted) of the golf club is inserted. A center axis line Z of this insertion hole 41 coincides with the axis line of the shaft.

Here, the reference state when setting the golf club head 100 on the ground will be described. First, as shown in FIG. 2, a state where the above center axis line Z is contained in a plane P1 that is perpendicular to the ground and the head is placed on the ground at a predetermined lie angle and real loft angle is prescribed as the reference state. The above plane P1 will be referred to as the reference perpendicular plane. Also, as shown in FIG. 2, the direction of the line of intersection between the above reference perpendicular plane P1 and the ground will be referred to as the toe-heel direction, and the direction that is perpendicular to this toe-heel direction and parallel to the ground will be referred to as the face-back direction. Also, the direction that is orthogonal to the toe-heel direction and the face-back direction may be referred to as the up-down direction.

Figure 4A:
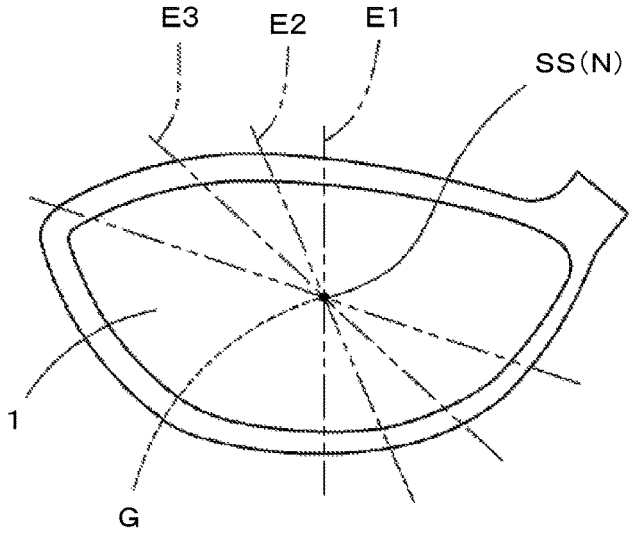
FIG. 4A is a diagram illustrating the boundary of a face portion.
Figure 4B:
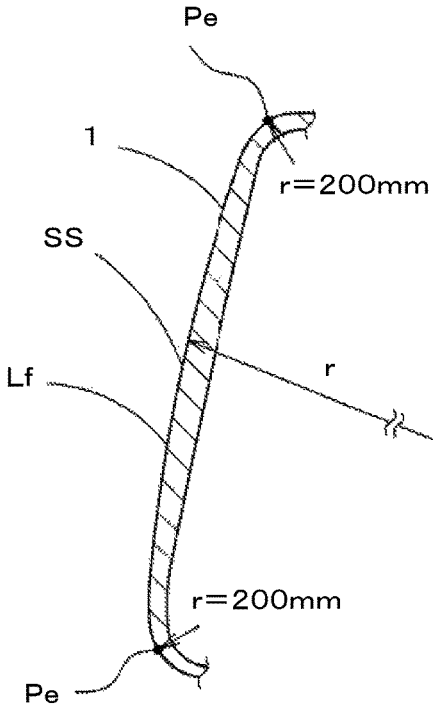
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a curvature radius r of a contour line Lf of the face outer surface first reaches 200 mm in a direction toward the face outer side from the sweet spot side, as shown in FIG. 4B, will be the periphery of the face portion 1, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour when the head is set in the reference state and viewed from directly above the center of gravity of the head 100 will be the boundary.

Also, the head 100 can, for example, be formed with a titanium alloy (Ti-6Al-4V, Ti-8Al-1Mo-1V, etc.) having a specific gravity of substantially about 4.3 to 4.5. Also, apart from a titanium alloy, the head can also be formed using one or two or more materials selected from stainless steel, maraging steel, an aluminum alloy, a magnesium alloy and an amorphous alloy, for example.

Also, the volume of this golf club head 100 is desirably from 90 $cm^3$ to 470 $cm^3$ inclusive, for example.

2. Assembly Structure of Golf Club Head

The golf club head 100 according to the present embodiment is constituted, as shown in FIG. 3, by assembling a head main body 101 having a crown portion 2 and a sole portion 3 and a cup-shaped face member 102 having a face portion 1 and a peripheral portion 15 extending from the periphery of the face portion. This head main body 101 has an opening 18 enclosed by the crown portion 2 and the sole portion 3, and the face member 102 is attached so as to close off this opening 18. That is, an end face of the peripheral portion 15 of the face member 102 is butted against an end face of the opening 18 of the head main body 101, and these portions are joined by welding (so-called cup face structure). The face member 102 is integrated with the head main body 101, by being attached to an edge portion of the opening 18 of the head main body 101, and the peripheral portion 15 of the face member 102 thereby functions as part of the crown portion 2 and the sole portion 3 of the head 100.

Accordingly, the surface that is integrally formed as a result of the peripheral portion 15 of the face member 102 being attached to the head main body 101 constitutes the crown portion 2 and the sole portion 3 of the head 100. Thus, strictly speaking, the crown portion 2 and the sole portion 3 of the head main body 101 are part of the crown portion 2 and the sole portion 3 of the head 100, although, in this specification, these portions of the head main body 101 may also be referred to simply as the crown portion 2 and the sole portion 3, without making this distinction.

3. Structure of Crown Portion

Next, the crown portion 2 will be described. As shown in FIGS. 1 to 3, the crown portion 2 is provided with a raised portion (first region) 21 that is arranged on the face portion side and a base portion (second region) 22 that is arranged further on the back side than the raised portion 21. The raised portion 21 is mainly a band-like region extending in the toe-heel direction along the face portion 1. On the other hand, the base portion 22 is a region that occupies a large part of the crown portion 2 at a lower position than the raised portion 21, and the periphery thereof contacts the sole portion 3. A sloped surface (step region) 23 that constitutes a step is formed on the boundary between the raised portion 21 and the base portion 22. The height of the face portion 1 in the up-down direction is thereby increased by the amount of the step between the raised portion 21 and the base portion 22.

This sloped surface 23 is configured so as to extend downward moving toward the back side. The sloped surface 23 can thereby be sighted from above, when the golf club head 100 is set in the reference state. That is, the sloped surface can be sighted by the golfer at address. The sloped surface 23 is formed along the raised portion 21, and is thus formed to be band-like in plan view, similarly to the raised portion 21.

As shown in FIG. 3, a width D of the raised portion 21 in the face-back direction is, in plan view, preferably set from 5 to 25 mm, and more preferably from 7 to 20 mm, for example.

Also, a width W of the sloped surface 23 in the face-back direction in plan view is preferably set from 1 to 9 mm, and is more preferably from 2 to 7 mm, for example. Furthermore, a height H of the sloped surface 23 is preferably set from 0.5 to 8 mm, more preferably from 0.5 to 6 mm, and particularly preferably from 0.5 to 5 mm, for example.

The base portion 22 curves so as to be upwardly convex. For example, the curvature radius in the cross-section shown in FIG. 3 can be formed to be from 120 to 200 mm. The curvature radius can be formed such that when three points on a line related to the above cross-section are prescribed, for example, the curvature radius increases approaching the front point.

Note that the cross-section in FIG. 3 is a cross-section in the face-back direction passing through a face center. The face center can be defined as follows. First, an arbitrary point Po is determined generally in a vicinity of the middle of the face portion 1 (face surface) in the toe-heel direction and the up-down direction. A line x extending in the toe-heel direction is drawn through this point Po, and a midpoint Px of this line x is determined. Next, on the face portion 1, a line y extending in the up-down direction is drawn through the point Px, and a midpoint Py of this line is determined. A process of redrawing the line extending in the toe-heel direction through the point Py determined in this way as the line x and thereinafter redetermining the point Py in a similar manner to that described above is then repeatedly performed. Anew point Py at which the distance between the previous point Py and the new point Py becomes 0.5 mm or less during repetition of this process is defined as the face center. Note that, more specifically, the above line x passing through the point Po is the line of intersection between the face surface (surface of the face portion 1) and a plane that contains the normal of the face surface passing through this point Po and is parallel to the toe-heel direction. Also, more specifically, the above line y passing through the point Px is the line of intersection between the face surface and a plane that contains the normal of the face surface passing through this point Px and is parallel to the up-down direction. Also, more specifically, the above line x passing through the point Py is the line of intersection between the face surface and a plane that contains the normal of the face surface passing through this point Py and is parallel to the toe-heel direction. Note that the lengths of the above lines x and y are measured along the face surface.

4. Structure of Inner Wall Surface of Crown Portion

Figure 5:
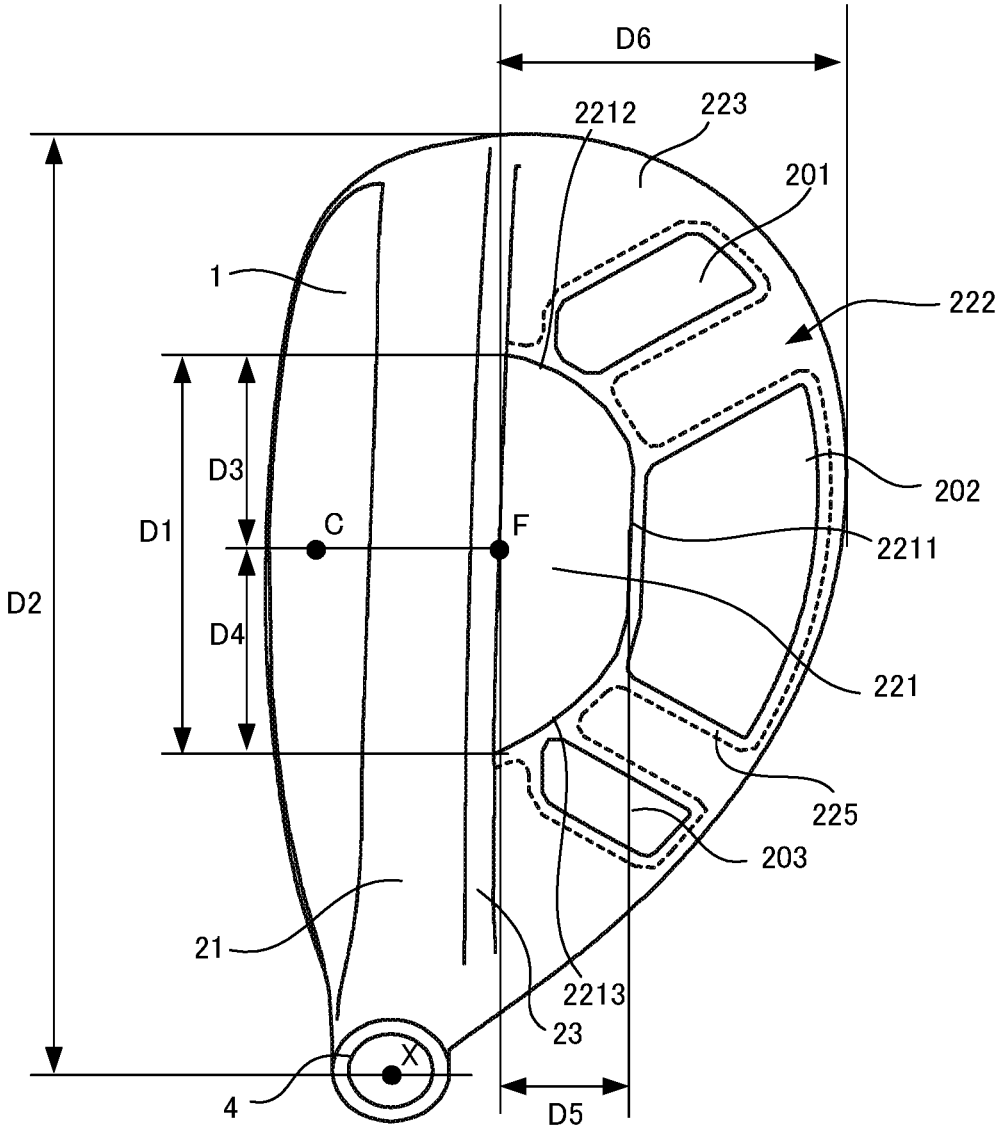
FIG. 5 is a plan view looking through the crown portion in FIG. 2.

Next, the structure of the inner wall surface of the crown portion 2 will be described, with reference to FIG. 5. FIG. 5 is a plan view enabling the change in wall thickness to be seen through the crown portion 2 in FIG. 2. As shown in FIG. 5, the inner wall surface of the base portion 22 of the crown portion 2 is unevenly formed, and a plurality of regions having different thicknesses are thereby formed in the crown portion 2. First, a first part 221 that contacts the sloped surface 23 and extends on the back side is formed in a vicinity of the center in the toe-heel direction. The first part 221 is formed in a generally trapezoidal shape, and has a straight rear end edge 2211 extending in the toe-heel direction on the back side, and a pair of circular arc-shaped side end edges 2212 and 2213 extending at an angle in the face-back direction on both sides of the rear end edge 2211 in the toe-heel direction. The end edge on the face side, that is, a length D1 of the portion that contacts the sloped surface 23 in the toe-heel direction, is longer than the length of the rear end edge 2211 in the toe-heel direction.

To be more specific, preferably the length D1 of the first part 221 in the toe-heel direction is 20 to 75% of a length D2 of the base portion 22 in the toe-heel direction. This length D2 is the length, in plan view, between an end edge on the toe side of the crown portion 2 and a center X of the insertion hole 41 of the hosel portion 4. Also, a toe-side end portion of the first part 221 can be set to a position separated from a face center C by 5 to 40 mm in the toe-heel direction (the length from the face center is D3). On the other hand, a heel-side end portion of the first part 221 can be set to a position separated from the face center by 5 to 30 mm in the toe-heel direction (the length from the face center is D4). Also, the length D5 of the first part 221 in the face-back direction can be set from 15 to 50% of a length D6 of the base portion 22 in the face-back direction. Note that these lengths D5 and D6 are given as lengths from a point F at which a line passing through the face center C and extending in the face-back direction intersects an end edge on the back side of the sloped surface 23.

In the base portion 22, a second part 222 that has a thinner wall thickness than the first part 221 is formed on the periphery of the first part 221. That is, the second part 222 is arranged on the toe side, the back side and the heel side of the first part 221, and contiguously surrounds the periphery of the first part 221. The wall thickness of the first part 221 can be set from 0.6 to 1.2 mm, for example. The wall thickness of the second part 222 is thinner than the first part 221, and will be described next in detail.

As shown in FIG. 5, a plurality of thin-walled portions 201 to 203, which are regions having a thin wall thickness, are further formed in the second part 222. Note that the wall thickness of these thin-walled portions 201 to 203 can be set from 0.3 to 0.6 mm, for example, and the wall thickness of the portion of the second part 222 other than the thin-walled portion 201 to 203 (hereinafter referred to as a thick-walled portion 223) can be set to be thicker than the thin-walled portions 201 to 203, such as from 0.45 to 0.8 mm, for example.

In the present embodiment, the three thin-walled portions 201 to 203 that are formed are referred to as a first thin-walled portion 201, a second thin-walled portion 202 and a third thin-walled portion 203 in order from the toe side to the heel side. These three thin-walled portions 201 to 203 are all formed in a rectangular shape, and extend radially toward the back side.

The first thin-walled portion 201 is coupled to the side end edge 2212 on the toe side of the first part 221, and is formed so as to extend to the toe side moving toward the back side. The second thin-walled portion 202 is coupled to the rear end edge 2211 of the first part 221, and is formed in a generally trapezoidal shape. That is, an end edge on the face side and an end edge on the back side of the second thin-walled portion 202 both extend generally in the toe-heel direction, and the length of the end edge on the face side is shorter than the length of the end edge on the back side. The third thin-walled portion 203 is coupled to the side end edge 2213 on the heel side of the first part 221, and is formed so as to extend to the heel side moving toward the back side.

All of the thin-walled portions 201 to 203 extend to a periphery on the back side of the crown portion 2. These thin-walled portions 201 to 203 are formed with a gap (thick-walled portion 223) therebetween, and these gaps also extend radially moving toward the back side. Furthermore, the boundary between these thin-walled portions 201 to 203 and the thick-walled portion 223 and the boundary between the thin-walled portions 201 to 203 and the first part 221 are constituted by a sloped surface 225 such that the wall thickness changes smoothly. In FIG. 5, an end edge of this slope 225 is shown with a dashed line.

5. Manufacturing Method of Golf Club Head

Next, an example of the manufacturing method of the above golf club head will be described. First, the above-mentioned head main body 101 and face member 102 are prepared. A head main body 101 and a face member 102 such as described above can be produced with various methods. For example, the head main body 101 can be manufactured by casting such as a well-known lost wax precision casting process. Also, the face member 102 can be manufactured by a method such as forging, plate pressing or casting, for example. Also, the pre-processing plate of the face member 102 that is used at this time is processed such that the rolling direction substantially coincides with the direction from an upper portion on the toe side of the face portion 1 to a lower portion on the heel side.

The golf club head is then completed when predetermined coating is performed after joining these portions by welding (TIG (tungsten inert gas) welding, plasma welding, laser welding, brazing, etc.), for example.

6. Features

The above embodiment enables the following effects to be obtained.

(1) In the crown portion 2, the raised portion 21 is formed higher than the base portion 22 via the sloped surface 23, thus enabling the height of the face portion 1 to be increased by the height of the raised portion 21. Thus, the rebound performance of the face portion 1 can be improved. Also, in the crown portion 2, only the raised portion 21 is formed higher, and the base portion 22 occupying a large part of the crown portion 2 is formed at a lower position than the raised portion 21, thus enabling the center of gravity of the head to be lowered.

(2) In the present embodiment, the thick-walled first part 221 is provided so as to contact the sloped surface 23, in a vicinity of the middle of the base portion 22 in the toe-heel direction. The following effects can thereby be obtained. That is, as a result of the first part 221, the wall thickness in a vicinity of the middle in the toe-heel direction where the impact of the ball is concentrated is thick, and thus rigidity increases and buckling deformation of the base portion 22 can be suppressed. Vibration of the base portion 22 in the up-down direction accompanying buckling deformation can also be suppressed. Energy loss caused by buckling deformation and vibration can thereby be reduced, and deformation of the face portion 1 can be further increased. That is, the face portion 1 can be made more flexible, and the energy that is given to the ball at the time of striking the ball can be increased, enabling the rebound performance of the head to be improved.

In particular, with the head according to the present embodiment, since the sloped surface 23 is formed as a step in the crown portion 2 between the raised portion 21 and the base portion 22, the periphery of the sloped surface 23 readily deforms, and thereby buckling deformation of the base portion 22 also tends to occur. Accordingly, the present invention is particularly advantageous when a first part 221 such as described above is provided in a head having the sloped surface 23.

Note that since the force that is imparted on the periphery of the first part 221, or in other words, on the second part 222 that surrounds the toe side, the heel side and the back side of the first part 221, at impact with the ball is smaller than on the first part 221, there is also little energy loss in the second part 222. Accordingly, the second part 222 does not need to be as rigid as the first part 221. Thus, in the present embodiment, the wall thickness of the second part 222 is reduced, thereby reducing the weight of the crown portion 2. As a result, a rise in the center of gravity of the head is suppressed.

For example, since the force imparted at impact with the ball becomes smaller moving toward the back side, the shape of the first part 221 is determined in consideration thereof. That is, the first part 221 becomes shorter in length in the toe-heel direction moving toward the back side, this being in consideration of the force that is imparted at impact with the ball, because this force decreases moving toward the back side. Accordingly, the size of the first part 221 can be reduced as a result of such a shape, thus enabling an increase in the weight of the crown portion 2 to be suppressed. In this way, in the present embodiment, the size (length in the toe-heel direction and the face-back direction) and shape of the first part 221 is determined, in consideration of the force that acts on the base portion 22 at impact.

(3) A plurality of thin-walled portions 201 to 203 are provided in the second part 222, thereby enabling the weight of the crown portion 2 to be reduced and the center of gravity of the head 100 to be lowered. Since the periphery of the thin-walled portions 201 to 203 is, however, surrounded by the thick-walled portion 223, a drop in the rigidity of the second part 222 is prevented.

7. Variations

Although an embodiment of the present invention has been described above, the present invention is not limited to the above embodiment, and various modifications can be made without departing from the spirit of the invention. Also, the following variations can be appropriately combined. Modifications such as the following can be made, for example.

7-1

The shape of the first part 221 in the above embodiment is one example, and is not limited thereto. That is, as long as the end edge on the face side contacts the sloped surface 23, the first part 221 may other than trapezoidal in shape, and can be formed in various shapes such as triangular, rectangular, polygonal and semicircular, for example. In the case of a shape having corners, however, stress is concentrated in the corners, and thus the contour of the first part 221 is preferably constituted by curves or straight lines. Also, the first part 221 is arranged in a vicinity of the center in the toe-heel direction, with the vicinity of the center being a region that covers at least the face center.

7-2

The form of the second part 222 is not particularly limited, and the shape and number of the thin-walled portions 201 to 203 that are formed in the second part 222 can also be appropriately changed. A configuration may also be adopted in which the thin-walled portions 201 to 203 are not provided and the wall thickness is generally constant.

7-3

The shape of the raised portion 21 and the sloped surface 23 is not particularly limited, and need only extend generally in the toe-heel direction. For example, the raised portion 21 and the sloped surface 23 may be formed in a U-shape in which both ends in the toe-heel direction extend on the back side. Also, the sloped surface 23 may not necessarily be planar. For example, the sloped surface can also be formed to be curved. Furthermore, the region between the raised portion 21 and the base portion 22 need not necessarily be formed as a slope, and may be a step that extends in the up-down direction.

7-4

The head according to the above embodiment has a cup face structure, but other forms are possible. For example, the head can be constituted by fitting the crown portion 2 into an opening for the crown portion formed in a head main body that includes the face portion 1 and the sole portion 3. Also, a cup face structure need not be adopted, and the head can be constituted by fitting a plate-like face member into an opening formed in the face portion 1 and welding the face member to the head main body.

7-5

The sole portion 3 is not particularly limited in shape, and can, from a design and structural viewpoint, be appropriately provided with recessed portions or grooves, for example.

LIST OF REFERENCE NUMERALS

1 Face portion
2 Crown portion
21 Raised portion (first region)
22 Base portion (second region)
21 First part
22 Second part
201-203 Thin-walled portion
23 Sloped surface (step region)
3 Sole portion
4 Hosel portion

What is claimed is:

1. A golf club head comprising:
a face portion;
a crown portion; and
a sole portion,
wherein the crown portion includes:
a first region extending in a toe-heel direction along at least part of the face portion;
a second region arranged further on a back side than the first region; and
a step region extending in the toe-heel direction between the first region and the second region, and extending downward toward the second region from the first region side, wherein the second region includes:

a first part arranged in the vicinity of the second region middle portion in the toe-heel direction, and contacting the step region; and a second part having a thinner wall thickness than the first part, and arranged to surround a periphery of the first part on the back side, the toe side and the heel side of the first part, and wherein the first part length in a face-back direction is 15 to 50% of the second region length in the face-back direction.

2. The golf club head according to claim 1, wherein the second part has a plurality of thin-walled portions extending radially on the back side from the first part and having a thinner wall thickness than other regions of the second part.

3. The golf club head according to claim 1, wherein the first part is formed such that the first part end edge contacting the step region and the first part end edge on the back side extend substantially parallel to each other in the toe-heel direction.

4. A golf club head comprising:

a face portion;

a crown portion; and a sole portion, wherein the crown portion includes:

a first region extending in a toe-heel direction along at least part of the face portion;

a second region arranged further on a back side than the first region; and a step region extending in the toe-heel direction between the first region and the second region, and extending downward toward the second region from the first region side, wherein the second region includes:

a first part arranged in the vicinity of the second region middle portion in the toe-heel direction, and contacting the step region; and a second part having a thinner wall thickness than the first part, and arranged to surround a periphery of the first part on the back side, the toe side and the heel side of the first part, and wherein the first part length in the toe-heel direction is 20 to 75% of the second region length in the toe-heel direction.

5. The golf club head according to claim 4, wherein the first part is formed to have a toe-side end portion in a position separated from the face portion center by 5 to 40 mm on the toe side, and to have a heel-side end portion in a position separated from the face portion center by 5 to 30 mm on the heel side.

6. The golf club head according to claim 4, wherein the second part has a plurality of thin-walled portions extending radially on the back side from the first part and having a thinner wall thickness than other regions of the second part.

7. The golf club head according to claim 4, wherein the first part is formed such that the first part end edge contacting the step region and the first part end edge on the back side extend substantially parallel to each other in the toe-heel direction.

8. A golf club head comprising:

a face portion;

a crown portion; and a sole portion, wherein the crown portion includes:

a first region extending in a toe-heel direction along at least part of the face portion;

a second region arranged further on a back side than the first region; and a step region extending in the toe-heel direction between the first region and the second region, and extending downward toward the second region from the first region side, wherein the second region includes:

a first part arranged in the vicinity of the second region middle portion in the toe-heel direction, and contacting the step region; and a second part having a thinner wall thickness than the first part, and arranged to surround a periphery of the first part on the back side, the toe side and the heel side of the first part, and the first part is formed such that the first part length in the toe-heel direction becomes shorter moving toward the back side.

9. The golf club head according to claim 8, wherein the second part has a plurality of thin-walled portions extending radially on the back side from the first part and having a thinner wall thickness than other regions of the second part.

10. The golf club head according to claim 8, wherein the first part is formed such that the first part end edge contacting the step region and the first part end edge on the back side extend substantially parallel to each other in the toe-heel direction.

* * * * *